United States Patent [19]

Keusch

[11] Patent Number: 4,988,040

[45] Date of Patent: Jan. 29, 1991

[54] DEVICE FOR SECURING A RAIL TO A SLEEPER

[75] Inventor: Siegfried Keusch, Plochingen, Fed. Rep. of Germany

[73] Assignee: Schwihag Gesellschaft fur Eisenbahnoberbau GmbH, Fed. Rep. of Germany

[21] Appl. No.: 254,943

[22] Filed: Jun. 8, 1988

Related U.S. Application Data

[63] Continuation of PCT DE87/00455 on Oct. 7, 1987, abandoned.

[30] Foreign Application Priority Data

Oct. 8, 1986 [DE] Fed. Rep. of Germany ..... 3634249
Mar. 19, 1987 [DE] Fed. Rep. of Germany ..... 3709034

[51] Int. Cl.[5] ..... E01B 9/48
[52] U.S. Cl. ..... 238/349; 238/331
[58] Field of Search ..... 238/310, 315, 317, 316, 238/331, 338, 344, 343, 345, 347, 349, 351

[56] References Cited

U.S. PATENT DOCUMENTS 1,815,815 7/1931 Vossloh ..... 238/349

FOREIGN PATENT DOCUMENTS 1146086 3/1963 Fed. Rep. of Germany ..... 238/349
1188110 3/1965 Fed. Rep. of Germany ..... 238/349
2461158 7/1975 Fed. Rep. of Germany .
2623944 12/1977 Fed. Rep. of Germany .
2554625 3/1979 Fed. Rep. of Germany .
2806817 3/1979 Fed. Rep. of Germany .
2810618 9/1979 Fed. Rep. of Germany .
3507310 9/1985 Fed. Rep. of Germany .
331477 4/1903 France .
389197 9/1908 France .
895594 1/1945 France .
1415724 9/1965 France .
2102478 2/1983 United Kingdom ..... 238/351

*Primary Examiner*—Robert P. Olszewski
*Assistant Examiner*—Mark T. Le
*Attorney, Agent, or Firm*—Thomas W. Speckman; Douglas H. Pauley

[57] ABSTRACT

This invention relates to a device for securing a rail to a railroad tie, and wherein a base plate is provided with guide ribs for abutting the rail foot. The base plate is secured to the tie and the guide ribs provide anchorage openings wherein anchors may be introduced into the anchorage openings for clamping the rail foot to the base plate. A resilient rail attachment with no threaded connections is obtained by the provision of extension arms integrally formed with the anchors and projecting beyond the rail foot. The anchors are disposed on both sides of the rail and resilient clamping elements are positioned in the longitudinal direction of the rail into channels formed between the rail foot and the extension arms. The clamping elements are subjected to deformation and supported under tension between the rail foot and the extension arms.

27 Claims, 5 Drawing Sheets

DEVICE FOR SECURING A RAIL TO A SLEEPER

CROSS REFERENCE TO RELATED APPLICATION

This application is a continuation application of copending International Application PCT/DE87/00455, filed Oct. 7, 1987, and abandoned on Aug. 8, 1988, designating the United States.

BACKGROUND OF THE INVENTION

Field of the Invention

The invention relates to a device for securing a rail to a railroad tie, and wherein the device comprises a base plate having guide ribs for abutting the foot of a rail. The device is securable to a tie and anchorage openings are provided in the guide ribs. An anchor is positionable in the anchorage openings and provided with an abutment for retaining a clamping element to clamp the rail foot to the base plate.

DESCRIPTION OF THE PRIOR ART

In known attachment devices of this kind, the anchors are in the form of hook screws that can be placed upon the clamping elements and can be clamped by means of nuts, as described in German OS No. 35 07 310, for example. These known devices have the disadvantage that the connection between the rail and the base plate is rigid, so that after it has been in use for about ten years, the worn base plate must be replaced. Since the base plates contain a large amount of steel material, they are reforged and put into service again, which means additional work. There have been many attempts to overcome the disadvantages of these known rail attachments.

In the case of rail attachments for modern rail traffic, there has been a shift away from the rigid connection between the rail and the base plate, and use is now made of a positive or non-positive resilient connection with spring clamping elements, as shown, for example, in German OS Nos. 24 61 158; 26 23 944; German AS Nos. 28 06 817; 2810618 and German Patent No. 25 54 625. However, all of these known devices required special base plates. It is therefore impossible to continue to use base plates with guide ribs of known types, such as are used in large numbers, and merely to use resilient clamping elements for bracing.

SUMMARY OF THE INVENTION

It is a feature of the present invention to provide a device, of the type mentioned at the beginning hereof, for securing a rail to a railroad tie, such that base plates with guide ribs used in large numbers are retained and a positive and/or non-positive resilient connection is obtained between the rail and the base plate, thus also facilitating assembly and dismantling.

According to a broad aspect of the invention this feature is accomplished in that the abutments are formed as extension arms and are integral with the anchors and project beyond the rail foot. Resilient clamping elements may be inserted on both sides of the rail and extend in the longitudinal direction of the rail. These clamping elements are positioned into channels or cavities formed between the rail foot and the extension arms with the clamping elements being subjected to deformation and maintained under tension between the rail foot and the extension arm.

The anchors and extension arms are inserted, like the hook screws, into the anchorage openings in the guide ribs of the base plates and are held therein. The resilient clamping elements are inserted, with no threaded attachment, between the rail foot and the extension arms of the anchors, and provide the desired positive and/or non-positive resilient connection between the rail and the base plate. This not only eliminates wear in the base plate, but the new device may be fitted to existing tracks without removing the base plates with little expenditure on parts and assembly. This is an improtant advantage of the new device, since all that is needed is to remove the nuts from the hook screws, then remove the hook screws and clamping elements from the anchorage openings in the guide ribs of the base plates, and to insert the new anchors. The fitting of the new clamping elements can then be performed by the use of simple manual handling tools.

According to one configuration, the design of the anchors is such that they are provided with a foot which has a cross-section dimensioned to fit into the cross-section of the anchorage openings in the guide ribs of the base plates. The extension arm of the anchors is made integral with the anchor, and projects from its upper end and over the rail foot when in position for clamping.

According to one configuration of the clamping element, they are of C-shaped form and are inserted centrally under the extension arms of the anchors with their ends disposed upon the rail foot. In order to achieve adequate spring movement, the ends of the clamping elements are bent inwardly to form loops. The clamping elements are preferably bent from sections of flat spring material.

According to another configuration, overload protection of the clamping elements is achieved in that the end faces of the bent ends, when the clamping element is in the operative position, are disposed at a predetermined distance from the center leg of the clamping element.

A specific operative position for the clamping elements is characterized in that they comprise central concave locking cavities on the outsides. The undersides of the extension arms of the anchors facing the clamping elements are formed as concave locking webs. The locking cavities and locking webs are disposed at right angles to the rail. The clamping elements are inserted, in the longitudinal direction of the rail until the locking web of the extension arm engages in the locking cavity of the clamping element.

During the positioning of the clamping elements, a guide is assured by the extension arms of the anchors which are designed for the width of the clamping elements and are provided, at their free ends, with a retaining web at least partly extending over a side edge or the thickness of the clamping elements.

According to another configuration, the clamping elements comprise, on both sides of the locking cavity, at predetermined distances from the outsides, additional cavities which, together with the locking webs, determine tension release locations for the clamping elements. This allows the clampling elements to be brought into a position of alignment, and held there, and wherein the rail can be moved in the longitudinal direction, with no need to release parts of the device from the base plate.

When the sections of flat material of the clamping elements are being bent, the locking cavities and the addtional cavities are formed. For optimal transfer of the force of the clamping elements to the rail foot, provision is made, according to another configuration, for the locking cavities and additional cavities to be formed in the clamping elements, when the secitons of flat material are being bent.

In order to reduce the cost of material for the anchors, according to one configuration, the anchor is in the form of a hollow anchor.

According to one configuration, overload protection of the clamping elements is obtained in that the end sections of the bent-in ends are at right angles to the center leg of the clamping elements and the end faces also ionclude an overload travel of about 2 mm to the center leg.

According to another configuration, the clamping elements are in the form of loops. The lower leg of the loop facing the rail foot forms two convex support sections between which is formed a bent-in section extending towards the upper leg, and serving as an abutment. The loop is divided in the central part of the upper leg, so that the end sections facing each other overlap. The outer end section facing the extension arm comprises on its outside a concave locking cavity for a locking web formed onto the underside of the extension arm. This makes it possible for the clamping elements to bridge large tolerances since they have a large clamping travel. In addition to this, these clamping elements can easily be fitted to, and removed from the extension arm cavity.

A definite bracing position is obtained, according to one configuration, in that the outer end section terminates in an end stop. The end stop prevents the clamping element from sliding through between the extension arm cavity and the rail foot.

The introduction of a clamping element into the channel formed between the extension arm of the anchor and the rail foot is facilitated in that an approximately semi-circular transition section, connecting the outer end section to the lower leg, comprises part areas running parallel with each other which are at an acute angle to the connecting line between the support points of the lower leg. The outside dimension between these areas is equal to, or slightly less than, the distance between the locking web of the extension arm and the rail foot. Provision is then made in this connection so that in an introductory position, the part areas of the transition section run parallel with the upper side of the rail foot until the locking web of the extension arm is inserted into the intermediate locking cavity which is let into the part area of the transition section which merges into the outer end section. This ensures that, in a neutral position, the locking web of the extension arm is introduced into the intermediate locking cavity. The lower leg with two support sections rests upon the upper side of the rail foot and the clamping member is located, by its own weight, in the relieved condition and is secured by the shape of the transition section, to the outer end section, before being pushed out of the neutral position.

Optimal clamping forces can be achieved with the loop-like clamping elements if both end sections overlap over the abutment of the lower leg of the loop and if, in the relieved position, the vertical distance between the locking cavity in the outer end section and the line connecting the support points of the lower leg of the loop is larger, by a predetermined clamping travel, than the distance between the locking web on the extension arm and the rail foot.

Maximum clamping force is obtained when, in a relieved position, the locking web on the extension arm is engaged in the locking cavity in the outer end section and the inner end section has shifted over the outer end section, by a predetermined over-travel, as far as the abutment. The loop thus rests under tension upon the extension arm and the rail foot.

Without departing from the basic concept of the invention, attachment of the anchor may also be made in an anchorage opening in a connecting plate between the rail and the tie or an anchorage opening made in the tie.

Forcing into and out of the channel is facilitated in that the extension arm comprises on both sides at right angles to the rail and above the locking web depressions for accommodating a tool to force the clamping element in and out of engagement.

BRIEF DESCRIPTION OF THE DRAWING

The invention will now be described in greater detail by reference to the examples thereof illustrated by the accompanying drawings wherein.

DESCRIPTION OF PREFERRED EMBODIMENTS

Figure 1:
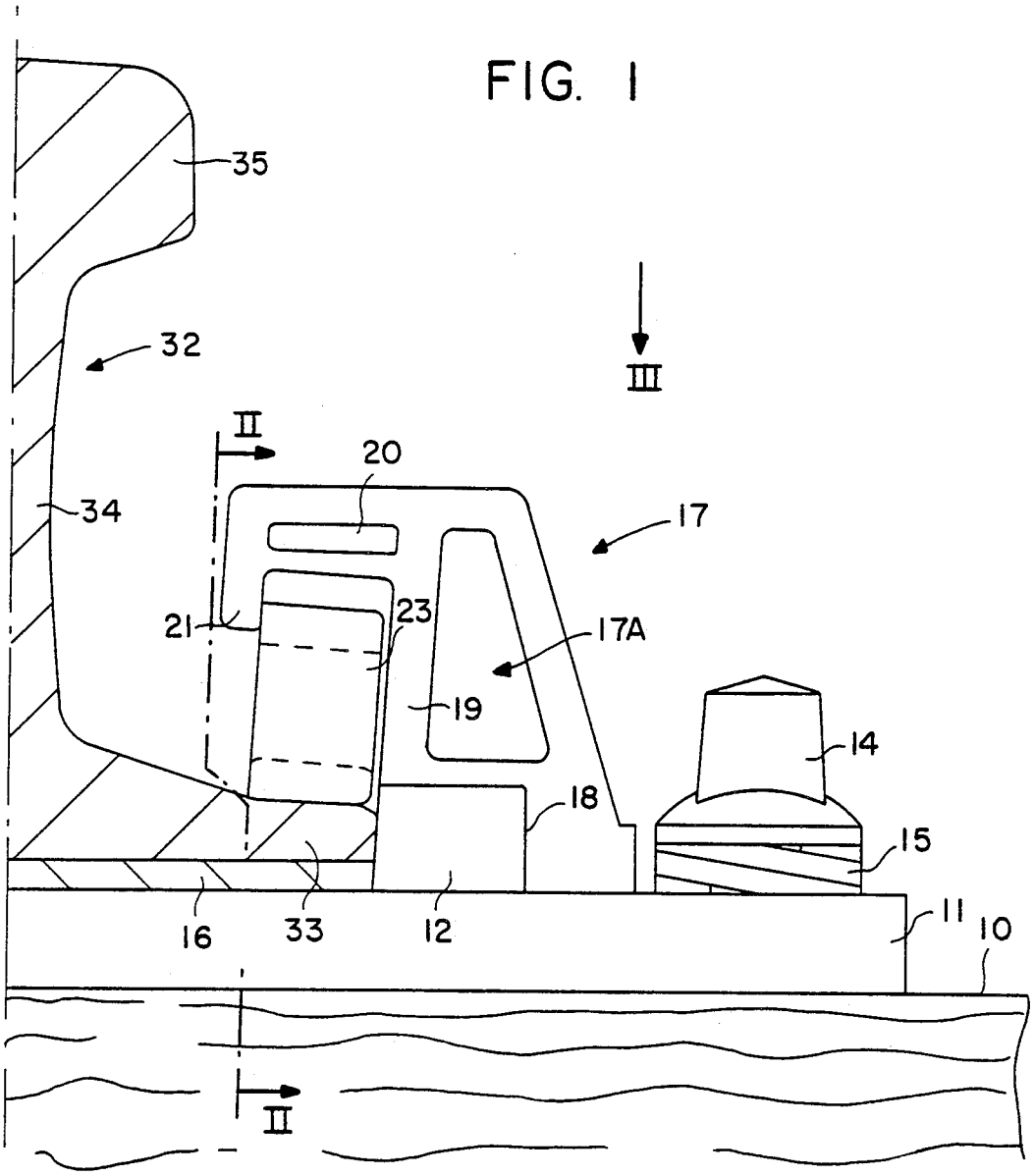
FIG. 1 is a side elevation illustrating an attachment device between the rail and the tie.

As shown in FIG. 1, the base plate 11 is secured to the tie 10 by means of capped screws 14 and spring washers 15. On the upper side of base plate 11 are formed two guide ribs 12 which run parallel with the rail 32 and are arranged at a distance from each other corresponding to the width of rail foot 33. Rail 32 rests upon tie 11 with resilient plate 16 therebetween.

Figure 2:
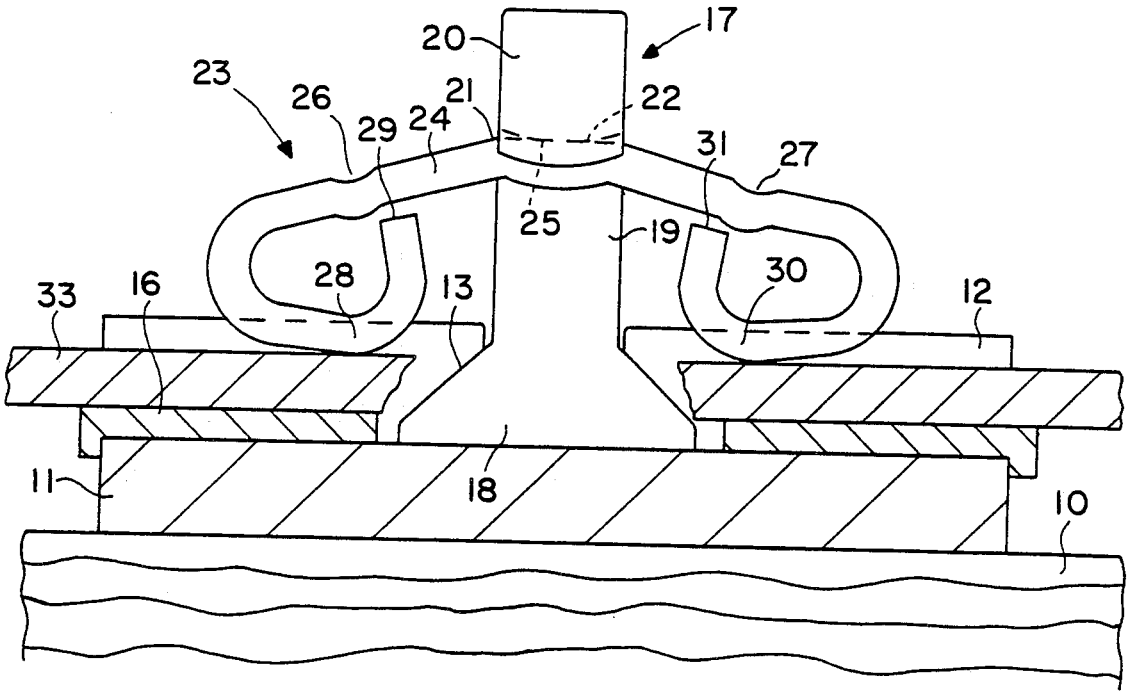
FIG. 2 is an end view along the line II—II in FIG. 1.

As can be seen from FIG. 2, anchor openings 13 are provided centrally in guide ribs 12 on base plate 11, with the cross-section of the opening 13 matching the hooks of known hook screws. However, instead of these hook screws, the foot 18 of the anchor 17 is inserted into the anchorage opening. The cross-section of foot 18 is designed to match that of the anchorage opening, so that inserted anchor 17 is held like a hook screw. Anchor 17 may be formed hollow, i.e., a hollow body 17A or it may be provided with lateral recesses in order to save material. Formed onto the upper end of anchor 17 is an extension arm 20 extending towards the rail 32. When anchor 17 has been pushed into its operative position, the extension arm projects above the rail foot 33.

Figure 3:
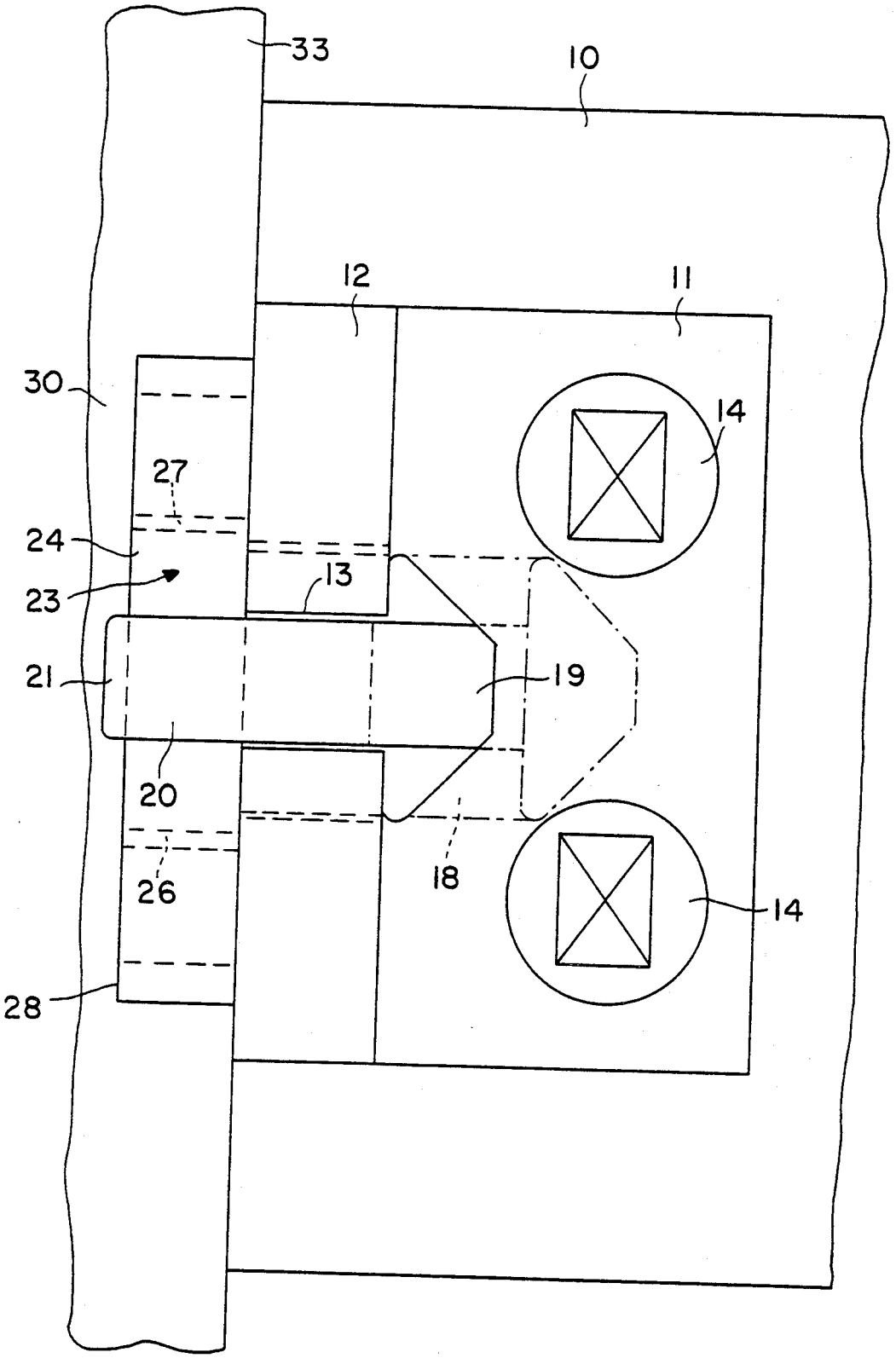
FIG. 3 is a plan view of the attachment point in the direction III of FIG. 1.

As shown in the plan view according to FIG. 3, with anchor 17 retracted in dotted lines, anchor 17 may also be inserted subsequently into the anchorage opening 13 in a base plate 11 connected to tie 10. This makes it possible to retro-fit the new device, i.e., to replace the old rigid hook connection.

The upper side of the rail foot 33 and the lower side of extension arm 20 of anchor 17 form support points or a channel for a resilient clamping element 23 which is introduced in the longitudinal direction of the rail 32, and when deformed bears under tension between the extension arm 20 and the rail foot 33. If the upper side of rail foot 33 is at an acute angle to the lower side of rail 32, then the lower side of extension arm 20 will also be inclined to the horizontal, and the side facing clamping element 23 of the vertical part 19 of anchor 17 will be inclined to the vertical by this angle, as shown in FIG. 1. This will again provide a cross-sectional rectangular channel for clamping element 23 which is in the form of a flexible spring made out of a section of flat spring material, such as spring steel. Retaining web 23 formed onto the free end of extension arm 20 extends at least over a part of the thickness of the clamping element 23 and holds the latter in retaining web 21.

It can be seen from FIG. 2 that clamping element 23 which in the form of a flexible spring comprises a central leg 24 arched convexly outward, and the ends 28 and 30 thereof are bent inwards to form loops. The convex outer side of the spring bears against the underside or in the cavity of extension arm 20, whereas ends 28 and 30 rest symmetrically upon the upper surface of rail foot 33. In the operative position the spring is retained immobilized, as shown in FIG. 2, by the underside of the arm 20 which is formed with a transverse locking web 22 which engages in the locking cavity 25 located centrally in the outer surface of the center leg 24 of the spring and which runs at right angles to rail 32. The spring 23 is thus preloaded to such an extent that the required clamping force of 1.25 Mp, at each attachment point, is obtained. With ends 28 and 30 thus bent, the travel of the spring is sufficient for these clamping forces to be achieved with resilient bracing.

Additional cavities 26 and 27 are formed on the outside of central leg 24 of clamping element 23, on both sides of locking cavity 25, and extend parallel thereto. Like locking cavity 25, these cavities 26 and 27 are formed while the section of flat material is being bent. The distance between additional cavities 26 and 27 is such that locking web 22 can engage in them when clamping element 23 is almost relaxed. This allows the clamping element to adjust itself, outside the operative position to a position in which rail 32 may still be adjusted axially, and the clamping element is prevented from falling out of the anchor.

The end sections of bent ends 28 and 30 of clamping element 23 are at right angles to the inside of center leg 24 and, in the operative position, they terminate at a predetermined distance from the inside of the center leg 24. This configuration provides overload protection against transverse forces acting upon the rail head. It has been found that a distance of 2 mm is sufficient.

FIG. 1 shows only one attachment point on one side of rail 32 provided with a web 34 and a rail head 35. A further similar attachment point, with an anchor 17 and a clamping element 23 is provided on the other side of the rail of each tie.

FIGS. 4 to 7 show another example of a clamping element 40 in the form of a loop which may easily be fitted into the channel between the extension arm 20 of anchor 17 and the rail foot, and may also be easily removed therefrom. At the same time, this clamping element provides a large clamping force in its operative position.

Figure 4:
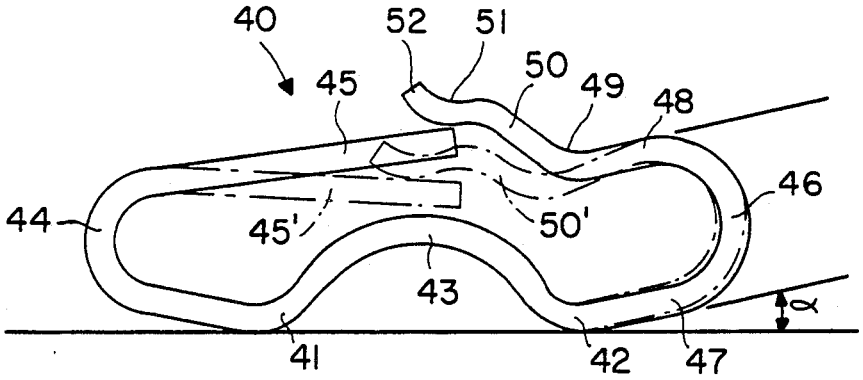
FIG. 4 is a side elevation of another example of the clamping element.

FIG. 4 is a side elevation of clamping element 40 designed as a loop. The lower leg facing the rail foot 33 is provided with two concave support sections 41 and 42 between which, the clamping element is bent inwardly to form an abutment 43, the convex side of which faces the upper divided leg of the loop. Above this central abutment 43, end portions 45 and 50 of the upper leg overlap. The outer end portion 50 is also provided on its outer side with a locking cavity 51 for locking into web 22 of the extension arm 20. As shown in dotted lines in FIG. 4, the inner end portion 45 can be deflected inwardly until it comes up against the abutment 43. The positions of end portions 45 and 50 marked 45' and 50' correspond to the braced position from which overload protection is obtained, with an over-travel of about 2 mm, by the stop provided by abutment 43. This over-travel is also needed to allow locking web 22 on extension arm 20 to engage in locking cavity 50.

Figure 5:
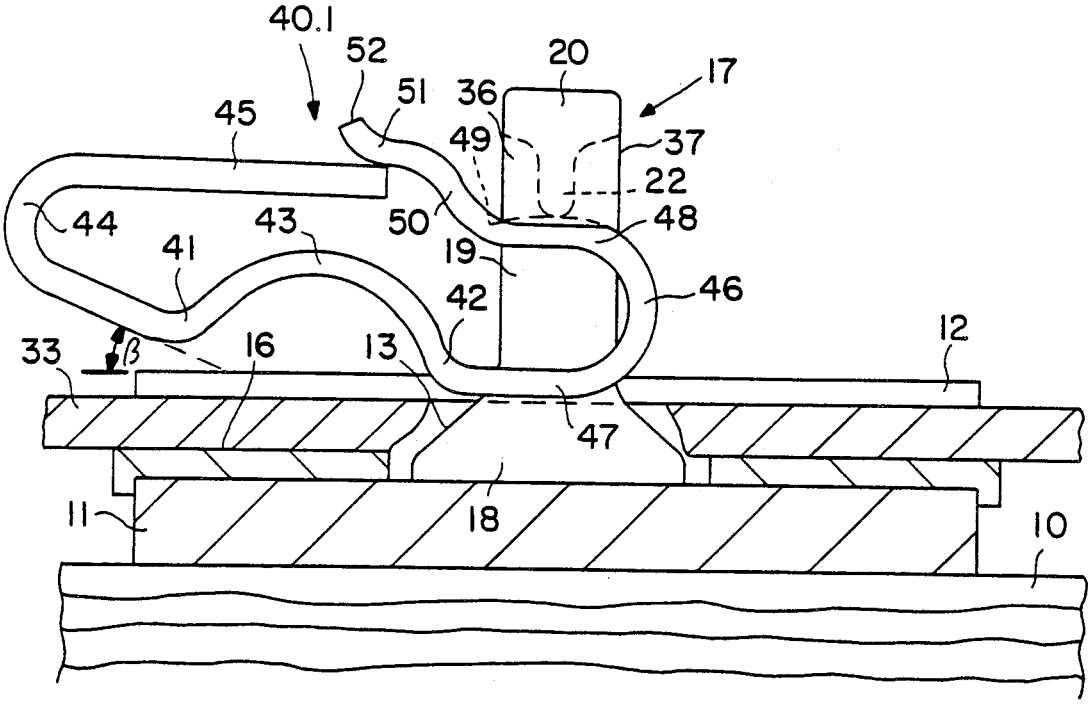
FIG. 5 is a side elevation view corresponding to that in FIG. 2, in which the clamping element according to FIG. 4 is in the introductory position.

Semi-circular transition section 46 of the loop merges, through part portions 47 and 48 which run parallel with each other, into a support section 42 and outer end portion 50. The part portions 47 and 48 are at an acute angle $\alpha$ to the line connecting support sections 41 and 42. The outside dimension between part portions 47 and 48 is equal to, or slightly less than, the distance between locking web 22 and the upper side of the rail foot 33. As shown in FIG. 5, in introductory position 40.1 clamping element 40 may be pushed into the channel between the locking web 22 and the rail foot 33. In this position, transition section 44 which connects support section 41 to inner end section 45 is raised as far as angle $\beta$, so that part portions 47 and 48 of transition section 46, after adjustment by an angle $\alpha$, run parallel with the upper side of the rail foot 33. The introductory movement of clamping element 40 comes to an end when locking web 22 is introduced into intermediate locking cavity 49 which then forms the transition from part portion 48 to other end section 50.

Figure 6:
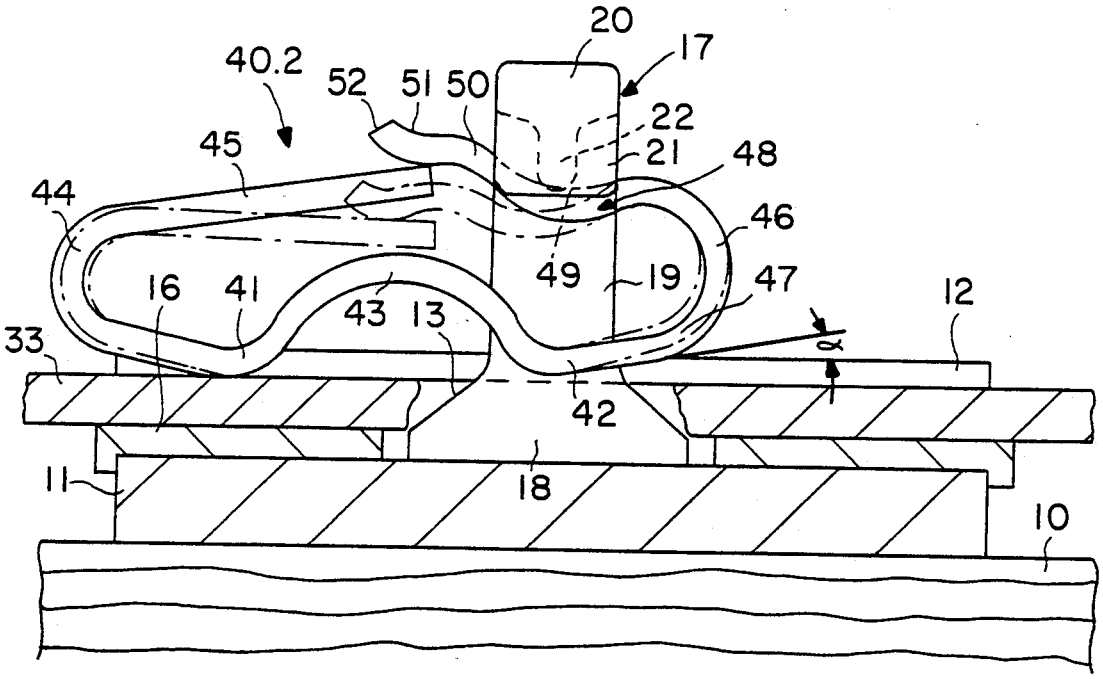
FIG. 6 is a side elevation view according to FIG. 5 with the clamping element in the neutral position.

As shown in FIG. 6, clamping element 40 assumes its neutral position by its own weight, as shown at 40.2, and wherein the clamping element 40 is held in the channel between extension arm 20 and rail foot 33.

Figure 7:
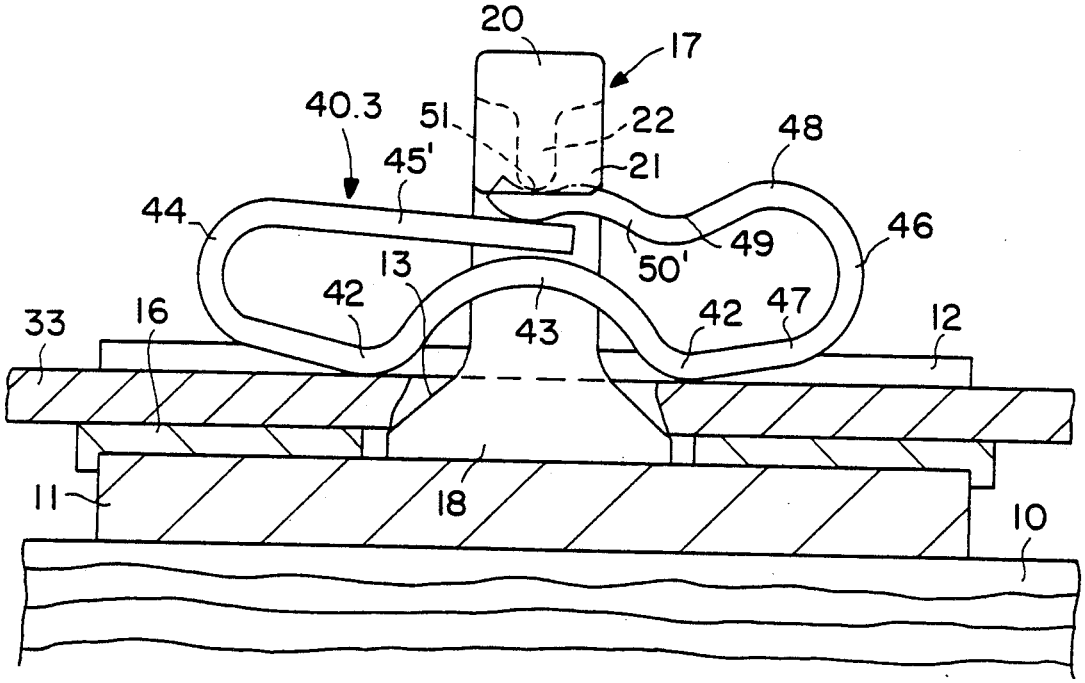
FIG. 7 is a side elevation view according to FIG. 5 in which the clamping element is in the bracing or clamping position.

If clamping element 40 is pushed still further into the channel, locking web 22 then slides along end portion 50 and deflects the inner end portion 45 thereunder, towards abutment 43, until locking web 22 engages in locking cavity 51. End portions 45 and 50 are displaced to a small over-travel and then return to bracing position 40.3, as shown in FIG. 7. Outer end portion 50 extends into end stop 52 which prevents clamping element 40 from being pushed further into the channel. The end portions assume the positions identified by numerals 45' and 50'.

Since high clamping forces must be applied, recesses 36 and 37 (see FIG. 5) are provided on both sides of extension arm 20 above locking web 22. When clamping element 40 is pressed into or out of the channel, a tool can be supported immovably in the recesses 36 and 37. When clamping element 40 is forced out, it firstly assumes its neutral position 40.2 according to FIG. 6. If transition section 44 is again raised to angle $\beta$, clamping element 40 may be withdrawn to its introductory position 40.1.

It is pointed out that achorage opening 13 for the foot 18 of anchor 17 may also be fitted on an intermediate plate of a different design and disposed between the tie 10 and rail foot 33. However, anchorage opening 13 may also be provided directly into the tie 10.

It is within the ambit of the present invention to provide any obvious modifications of the examples of the preferred embodiment as described herein, provided such modifications fall within the scope of the appended claims.

What is claimed:

1. A device for securing a rail to a railroad tie, said device comprising a base plate having guide ribs for abutment against a rail foot, said base plate being securable to said tie, anchorage openings formed in said guide ribs, anchors positionable in respective ones of said anchorage openings, each said anchor having an abutment for clamping said rail foot to said base plate, the improvement comprising:

said abutment being an extension arm formed integrally with said anchor and projecting beyond and above said rail foot, said anchor disposed on both sides of said rail, a resilient clamping element disposed in the longitudinal direction of said rail into a channel formed between the rail foot and said extension arm, said clamping element having a concave locking cavity centrally positioned on an outer periphery thereof, said extension arm having a convex transverse locking web in a face thereof engaging said concave locking cavity of the clamping element, said locking cavity and said locking web extending at right angles to said rail, said clamping element being C-shaped bearing centrally upon said extension arm, said clamping element having a free end resting upon said rail foot, said clamping element being subjected to deformation and being supported under tension between said rail foot and said extension arm.

2. A device according to claim 1 wherein said anchors are each provided with a foot having a cross-section to fit into the cross-section of said anchorage openings of said guide ribs of said base plate, said extension arms being formed integral with said anchors and projecting in the direction of insertion of said foot, said extension arm being formed in the upper end of said anchors.

3. A device according to claim 2 wherein, said rail foot extends at an acute angle to an underside of said rail, said extension arm is formed with an inclined surface web facing said rail foot, said inclined surface having a similar acute angle.

4. A device according to claim 2 wherein said anchor is in the form of a hollow chamber anchor.

5. A device according to claim 1 wherein said rails have an upper side of said foot extending at an acute angle to an underside of said rail, said extension arm is formed with an inclined surface web, facing said rail upper side, said inclined surface has a similar acute angle.

6. A device according to claim 1, wherein said anchor is in the form of a hollow chamber anchor (17*a*).

7. A device according to claim 1 wherein said free ends are bent inwardly and shaped as loops.

8. A device according to claim 7 wherein said clamping elements are bent from sections of flat spring material to form flexible springs.

9. A device according to claim 7 wherein said extension arm extends at right angles to the rail and has depressions on opposed sides of said transverse locking web for the insertion of a tool for forcing said clamping element in and out of engagement therewith.

10. A device according to claim 1 wherein said clamping elements are bent from sections of flat spring material to form flexible springs.

11. A device according to claim 10 wherein said clamping element comprises said central locking cavity and additional cavities, one on a respective side of said central locking cavity, which together with a locking web formed in said extension arm determine tension-release locations for said clamping element.

12. A device according to claim 11 wherein when the sections of flat spring material are bent, said locking cavity and said additional cavities are formed in said spring material.

13. A device according to claim 1 wherein said bent ends have end faces when in an operative position, and disposed at a predetermined distance from a center leg or said clamping element.

14. A device according to claim 13 wherein said bent ends are at right angles to a central section of said clamping element, said bent ends have free end faces including an overload travel space of about 2 mm from said central section and said clamping element has additional cavities, one on a respective side of a central locking cavity.

15. A device according to claim 1 wherein said extension arm of said anchors define a cavity having a width to receive said clamping element therein, and a retaining web formed at a free end of said arm and extending downwarly to at least partly cover the side wall thickness of said clamping element associated therewith.

16. A device for securing a rail to a railroad tie, said device comprising a base plate having guide ribs for abutment against a rail foot, said base plate being securable to said tie, anchorage openings formed in said guide ribs, anchors positionable in respective ones of said anchorage openings, each said anchor having an abutment for clamping said rail foot to said base plate, the improvement comprising:

said abutment being an extension arm formed integrally with said anchor and projecting beyond and above said rail foot, said anchor disposed on both sides of said rail, a resilient clamping element disposed in the longitudinal direction of said rail into a channel formed between the rail foot and said extension arm, said clamping element being subjected to deformation and being supported under tension between said rail foot and said extension arm;

said anchors each provided with a foot having a cross-section to fit into the cross-section of said anchorage openings of said guide ribs of said base plate, said extension arms being formed integral with said anchors and projecting in the direction of insertion of said foot, said extension arm being formed in the upper end of said anchors, said extension arm extending at right angles to the rail and having depressions on opposed sides of a central locking web for the insertion of a tool for forcing said clamping element in and out of engagement therewith.

17. A device for securing a rail to a railroad tie, said device comprising a base plate having guide ribs for abutment against a rail foot, said base plate being securable to said tie, anchorage openings formed in said guide ribs, anchors positionable in respective ones of said anchorage openings, each said anchor having an abutment for clamping said rail foot to said base plate, the improvement comprising:

said abutment being an extension arm formed integrally with said anchor and projecting beyond and above said rail foot, said anchor disposed on both sides of said rail, a resilient clamping element disposed in the longitudinal direction of said rail into a channel formed between the rail foot and said extension arm, said clamping element being subjected to deformation and being supported under tension between said rail foot and said tension arm wherein said clamping elements are in the form of loops, each said loop having a lower leg facing said rail foot, each said loop forming two convex support sections between which a section is bent in towards an upper leg which serves as an abutment, each said loop being discontinuous in a central part of said upper leg and forming end sections which face each other and overlap, one of said end sections facing said extension arm having on its upper surface a concave locking cavity for engagement with a locking web formed in the underside of said extension arm.

18. A device according to claim 17 wherein an approximately semi-circular transition section connects one of said end sections to said lower leg, and defines opposed sections running parallel with each other and which are at an acute angle to a connecting line between support sections of said lower leg, the outside dimension between said opposed sections being equal to or slightly less than the distance between said locking web of said extension arm and said rail foot.

19. A device according to claim 18 wherein one of said opposed sections of said transition section associated with one of said end sections merges from an intermediate locking cavity in an outside surface thereof.

20. A device according to claim 17 wherein said two end sections overlap over said support sections of said lower leg of said loop.

21. A device according to claim 17 wherein said one of said end sections terminates in an end stop.

22. A device according to claim 21 wherein an approximately semi-circular transition section connects each said end section to said lower leg, and defines opposed sections running parallel with each other and which are at an acute angle $\alpha$ to a connecting line between support points of said lower leg, the outside dimension between said opposed sections being one of equal to and slightly less than the distance between said locking web of said extension arm and said rail foot.

23. A device according to claim 22 wherein one of said opposed sections of said transition section associated with one of said end sections merges from an intermediate locking cavity in an outside surface of said one of said end sections.

24. A device according to claim 17 wherein in a tension release position a vertical distance between said locking cavity of said one of said end sections and a connecting line between said support sections of said lower leg of said loop is greater by a predetermined clamping travel than the distance between said locking web of said extension arm and said rail foot.

25. A device according to claim 17 wherein in an introductory position an opposed section of a transition section runs in parallel with an upper side of said rail foot.

26. A device according to claim 17 wherein in a neutral position said locking web of said extension arm is disposed into an intermediate locking cavity of said clamping element while said two support sections of said lower leg rest upon an upper side of said rail foot, and while said clamping element is still in a relieved condition and is held in neutral.

27. A device according to claim 17 wherein, in a braced position said locking web of said extension arm is disposed in said locking cavity in said one of said end sections and said loop bears under tension upon said extension arm and said rail foot.

* * * * *